United States Patent [19]

Gurioli

[11] 4,196,810

[45] Apr. 8, 1980

[54] CIGARETTE HOPPER WITH DEFECTIVE CIGARETTE REJECT MEANS

[75] Inventor: Pasquino Gurioli, Bologna, Italy

[73] Assignee: AMF Sasib Societa' per Azioni Scipione Innocenti Bologna, Bologna, Italy

[21] Appl. No.: 851,752

[22] Filed: Nov. 15, 1977

[30] Foreign Application Priority Data

Nov. 26, 1976 [IT] Italy ..... 12906 A/76

[51] Int. Cl.[2] ..... B07C 5/04

[52] U.S. Cl. ..... 209/535; 209/675

[58] Field of Search ..... 209/535, 659, 660, 675

[56] References Cited

U.S. PATENT DOCUMENTS

| | | | |
|---|---|---|---|
| 2,580,940 | 1/1952 | Molins et al. | 209/535 |
| 3,456,787 | 7/1969 | Pinkham et al. | 209/535 |

FOREIGN PATENT DOCUMENTS

| | | | |
|---|---|---|---|
| 517878 | 3/1955 | Italy | 209/535 |
| 260150 | 10/1926 | United Kingdom | 209/535 |

*Primary Examiner*—Joseph J. Rolla

*Attorney, Agent, or Firm*—Spencer & Kaye

[57] ABSTRACT

A hopper having a filling area and a supply area for cigarettes to be delivered, means to prevent cigarettes from dropping directly into the supply area from the filling area, and sliding channels supporting acceptable cigarettes as they move therethrough into the supply area, and permitting reject cigarettes and cigarette parts to drop out of the hopper.

11 Claims, 2 Drawing Figures

CIGARETTE HOPPER WITH DEFECTIVE CIGARETTE REJECT MEANS

Figure 1:
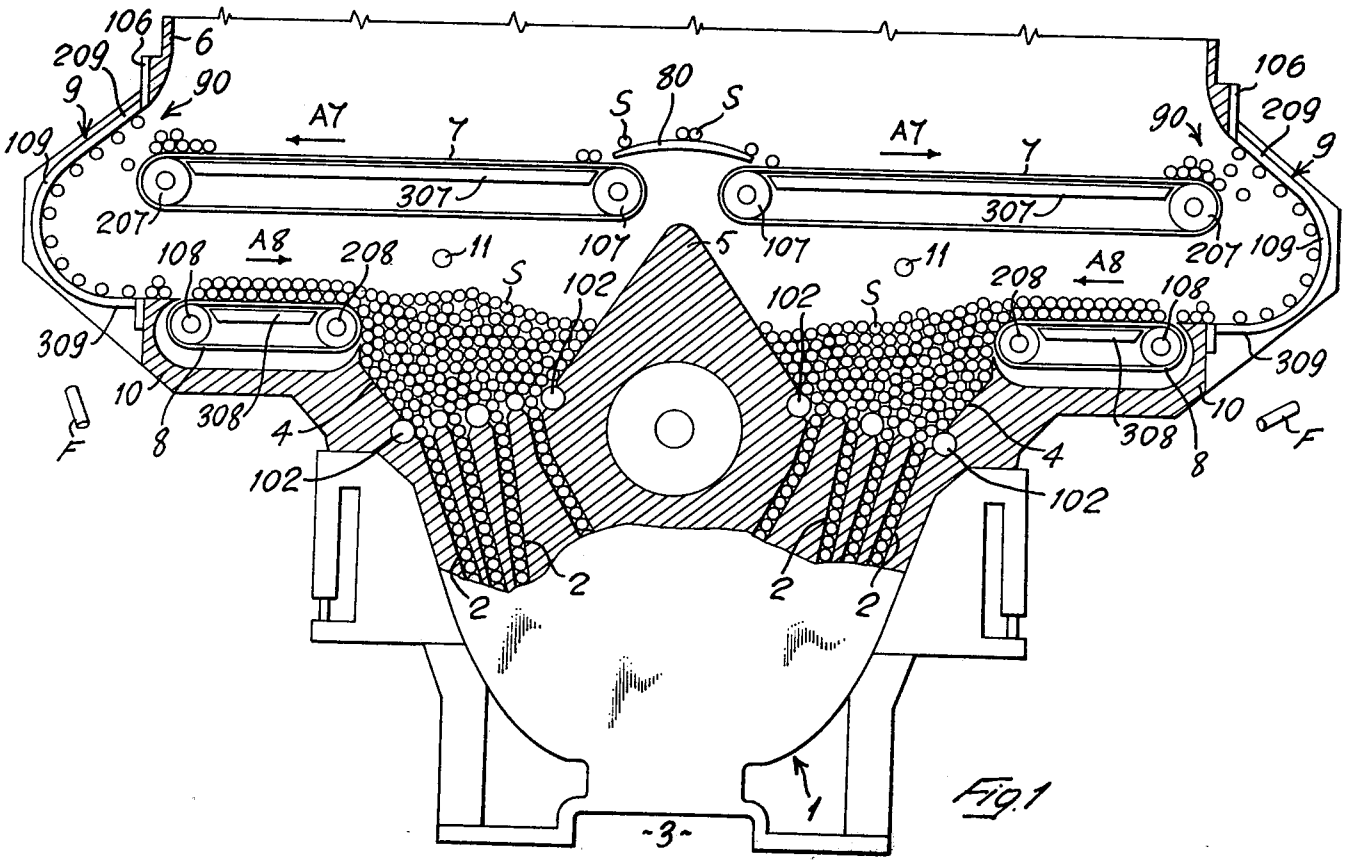

This invention relates generally to hoppers for cigarette packing machines and more particularly to such hoppers with means for rejecting defective cigarettes and cigarette parts.

Hoppers of the type concerned normally have a top inlet for receiving aligned cigarettes from cigarette trays, and maintain the aligned parallelism of the cigarettes. The bottom of the hopper is provided with a plurality of depending delivery channels or passages along which cigarettes descend by gravity and converge into a cigarette block in a cigarette block forming chamber below the hopper. The formed block of cigarettes is subsequently moved to the packing area where the block is suitably enclosed in packaging material while simultaneously additional cigarettes are being formed into another cigarette block.

To form regular and uniform cigarette blocks, it is necessary that only acceptable and complete cigarettes are delivered to the cigarette block forming chamber. To insure this and as a final means in addition to other inspection and rejection devices along the cigarette forming path, the present invention proposes providing a hopper with means for rejecting defective cigarettes and cigarette parts to prevent their delivery to the cigarette block forming chamber.

According to this invention, the upper filling portion of the hopper communicates with the hopper cavity through a pair of side and inwardly curved slide channels each defined on its outer curved side by a pair of spaced parallel guides extending across an opening in the side wall of the hopper and retaining cigarettes as they move into the hopper cavity. While the space between the guides of each pair is smaller than the length of an acceptable cigarette, the spaced guides will not support both ends of a defective cigarette which will, as will broken off cigarette parts, and filter pieces, pass between the spaced pair of guides and fall out of the hopper.

Another object of the present invention is to provide the foregoing hopper with a pair of conveyor belts each forming an extension of the spaced guides of one of said slide channels and providing a substantially horizontal cigarette supporting surface moving toward the center line of the hopper.

Still another object of the present invention is to provide the foregoing hopper with a pair of endless conveying belts in horizontal end to end alignment with the outer end of each belt defining, at least in part, the inner curved side of one of the slide channels and a fixed bridge extending across the inner ends of the belts with the belts themselves forming a covering for the hopper cavity.

And another object of the present invention is to provide the cavity of the foregoing hopper with level sensing means controlling movement of said endless conveying belts the, upper runs of said belts moving opposite to one another each toward one of said slide channels.

Figure 2:
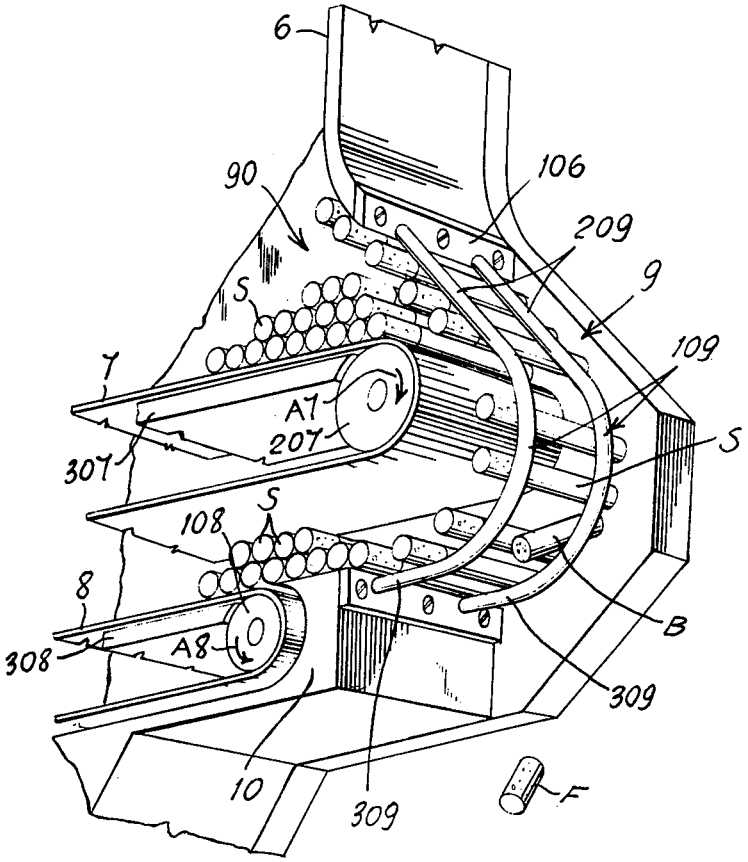

The foregoing and other objects and advantages of the present invention will be more fully understood by reference to the following description in conjunction with the drawings in which:

FIG. 1 is an elevational view, partially in section, of a cigarette packer delivery hopper made in accordance with the present invention, and FIG. 2 is a partial perspective view of the hopper of FIG. 1.

Referring now to the drawings, a delivery hopper 1 receives cigarettes S in an orderly manner all aligned in a parallel stacking array and delivers the cigarettes which move downwardly one after another through channels 2, because of gravity, and converge at a central area 3 at the bottom of the hopper where they enter a block forming chamber (not shown) and form a block of cigarettes to be packaged. The hopper 1 is provided with two delivery pockets or chambers 4 which are laterally separated from one another by a ridge or wall 5 along the center line of the hopper. As shown, the wall 5 extends upwardly from the bottom surfaces of the pockets 4, and a set of the channels 2 extend from each of the pockets 4 to the central bottom portion 3 of the hopper 1. Lead in rollers 102 are preferably provided at the mouths of the channels 2 to facilitate the movement of the cigarettes S from the pockets 4 into the delivery channels.

A mouth or inlet 6 is provided at the one end of the hopper 1 for receiving cigarettes S from cigarette trays (not shown) in a well-known manner. A pair of cigarette conveying belts 7 are disposed in end to end alignment on a common or single horizontal plane just inside of the hopper mouth 6. The belts 7, the adjacent ends of which are disposed above the wall 5, extend laterally from their adjacent ends in opposite directions toward the sides of the hopper 1 and are spaced therefrom to form passage ways or sliding channels through which cigarettes move from the mouth 6 to the pockets or chambers 4 where they may be assisted by an endless belt 8 adjacent to each of the sliding channels as will be further described.

A fixed bridge 80 is provided to extend across the opening between and to lap the adjacent ends of the belts 7, and with these belts forms a cover or horizontal wall above the pockets 4 preventing cigarettes from falling directly therein from the mouth 6. The belts 7 alternatively move continuously or intermittently on demand in the directions of the arrows A7 thereby urging cigarettes into the inlets 90 of the sliding channels from the mouth 6.

The outer side of each of the sliding channels consists of an opening 9 in a hopper side wall with a pair of spaced parallel guides 109 disposed across the opening, the space between each pair of parallel guides being smaller than the length of a filter cigarette. Each of the guides 109 has an upper rectilinear portion sloping away from the adjacent belt 7, and is connected at its upper end by a mounting base 106 to the hopper side wall along the lower portion of the mouth 6. The lower portion 309 of each guide 109 curves inwardly toward a delivery chamber 4 and is connected at its end to the side of a hollow wall portion 10 which houses one of the belts 8.

Belts 7, when stationary will support cigarettes provided to the hopper 1 through the mouth 6. Because of the natural slope, cigarettes will move into the inlets 90 of the sliding channels, along the guides 109 to the continuously moving endless belts 8 which move in the direction of arrows 8A and urge the cigarettes toward the wall 5 into the pockets 4. As best shown in FIG. 2, both ends of acceptable cigarettes S are supported by the guides 109 as the move toward the pocket 4. However, defective cigarettes B with filter tips F broken off and such filter tips fall between the guides 109 and out of the hopper 1 through openings 9.

The cigarettes from the sliding channels normally fill the delivery pocket 4 to continuously provide a sufficient supply of cigarettes to delivery channels 2. Each pocket 4 is provided with a level sensing means 11, such as a photoelectric cell which causes belts 7 to move in the direction of arrows A7 when the level of cigarettes in the pockets 4 drop below a predetermined minimum, and stops belts 7 when the supplies of cigarettes in pockets 4 are re-established. Therefore, the belts 7 and 8 act to maintain the supply of cigarettes in pockets 4 in equilibrium by providing cigarettes to the pockets at the same rate as they are depleted or drained off by the delivery channels 2.

Each belt 7 is moved between an entry or idler roller or pulley 107 and an exit or drive roller or pulley 207, and the carrying portion of the belt is supported on a fixed guide 307. Similarly, each belt 8 is moved between a collection or entry roller 108 and an exit roller 208, and the supporting run of each belt 8 is provided with a fixed support. As an alternative to the intermittent operation, each belt 7 may be provided with a variable speed drive controlled by a sensing means 11.

From the foregoing, it should appear apparent that the present invention provides an automatic rejecting means in a cigarette hopper which prevent defective cigarettes and cigarette parts from being delivered to the block forming chamber of the packer.

Although a preferred embodiment of the invention has been shown and described herein, it should be expressly understood that the details thereof are not limited thereto.

What is claimed is:

1. A hopper for cigarette packers, comprising a mouth portion at the top thereof for receiving orderly groups of cigarettes which are parallel to one another; two delivery chambers disposed side by side below said mouth portion, each having a plurality of delivery channels depending therefrom for delivering columns of cigarettes to a cigarette block forming chamber of the packer; means forming a wall which extends upwardly from the bottoms of said delivery chambers along the center of said hopper separating each of said delivery chambers from the other; a pair of spaced parallel side walls each having an opening therein extending downwardly from said mouth portion along one of said delivery chambers; horizontal wall means disposed between said mouth portion and said delivery chambers preventing cigarettes from dropping directly into said chambers from said mouth portion; a pair of outwardly curved sliding channels each connected to a different one of said side walls and extending over the opening thereof for supporting acceptable cigarettes moving from said mouth portion to one of said delivery chambers and with said opening causing defective cigarettes and cigarette parts moving from said mouth portion to drop out of said hopper; and said horizontal wall means extending laterally across said hopper toward said side walls with its ends spaced from said sliding channels.

2. A hopper in accordance with claim 1, and each of said sliding channels comprising a pair of spaced outwardly curved guides connected at their top and bottom ends to one of said hopper side walls; and the space between said gudies being smaller than the length of an acceptable cigarette.

3. A hopper in accordance with claim 2, and a pair of endless belts each disposed in a different one of said delivery chambers adjacent one of said sliding channels; and each of said endless belts having an upper cigarette carrying run continuously moving in a direction toward said vertical wall means thereby moving cigarettes from said adjacent sliding channel into said delivery chamber in which said endless belt is disposed.

4. A hopper in accordance with claim 3, and said horizontal wall means comprising two endless conveying belts disposed in end to end alignment on a common horizontal plane; a fixed bridge extending across the adjacent ends of said conveying belts and the space therebetween; and each of said conveying belts having an upper cigarette supporting run moveable in a direction away from the other of said conveying belts for urging cigarettes in said mouth portion toward said sliding channels.

5. A hopper in accordance with claim 4, and each of said conveying belts having an intermittently driven driving pulley; and level sensing means disposed in each said delivery chamber controlling the intermittent drive of one of said conveying belts in accordance with the sensed cigarette-level in each delivery chamber.

6. A hopper in accordance with claim 4, and each of said conveying belts having a driving pulley operable at a controlled variable speed; and level sensing means in each of said delivery chambers for controlling the speed of said conveying belts in accordance with the sensed cigarette levels in said chambers.

7. Device for rejecting defective cigarettes and parts thereof at the entry to a cigarette packer delivery hopper into which the cigarettes are fed by trays overturned on the hopper mouth, wherein said hopper has an upper filling opening which communicates with lower pockets, from which there depart channels which convey cigarettes in groups to a chamber for forming organized blocks of cigarettes to be sent to machine packing stations, the communication between said filling opening and said pockets being obtained through side and inwardly curved channels, each of these channels being associated with one respective pocket of the underlying pockets and being delimited, on its external curved side, by a pair of curved parallel guides which laterally support the cigarettes in transit towards said pockets, the interdistance between the two guides being less than the length of a regular filter tip cigarette so that only full-length cigarettes are supported by said curved guides along their entire path, while shorter cigarettes and pieces of filters will, for lack of adequate support at two points, pass between said guides and fall out away from the underlying pockets.

8. Device according to claim 7, wherein, as a continuation of said curved guides there is located a respective means for inducing the cigarette advance from the descending channel to the corresponding pocket, each advancing means comprising a cigarette conveying belt which runs substantially horizontally in the direction towards the hopper center line up to the limit of the respective pocket.

9. Device according to claim 7, wherein both said channels are delimited, on their inner curved side, at least partly by the discharging end of a respective conveying belt disengaging the inlet of the respective channel, each belt extending substantially horizontally from the hopper center line area, said belts, together with a fixed central bridge, forming a covering for the underlying delivery hopper pockets.

10. Device according to claim 9, further comprising actuating means, associated with respective cigarette level sensing units in the corresponding underlying pocket, to actuate temporarily one or the other of said belts in the direction towards the inlet of the respective sliding channel or to actuate continuously both of said belts, increasing the speed of one or the other, every time the corresponding sensing unit detects that the cigarette level in the corresponding hopper pocket has descended below a present level, the temporary movement of the respective belt, or the continuous movement at increasing speed, lasting until the preset level is reestablished.

11. Device according to claim 10, wherein said sensing unit comprises a photoelectric cell for detecting the level of cigarettes.

* * * * *